US007396450B2

(12) United States Patent
Bennett et al.

(10) Patent No.: US 7,396,450 B2
(45) Date of Patent: Jul. 8, 2008

(54) METHOD OF REDUCING AMOUNT OF PEROXIDES, REDUCING FUEL SEDIMENTS AND ENHANCING FUEL SYSTEM ELASTOMER DURABILITY, FUEL STABILITY AND FUEL COLOR DURABILITY

(75) Inventors: Joshua J. Bennett, Richmond, VA (US); Scott D. Schwab, Richmond, VA (US)

(73) Assignee: Afton Chemical Corporation, Richmond, VA (US)

( * ) Notice: Subject to any disclaimer, the term of this patent is extended or adjusted under 35 U.S.C. 154(b) by 867 days.

(21) Appl. No.: 10/665,907

(22) Filed: Sep. 18, 2003

(65) Prior Publication Data

US 2005/0061749 A1 Mar. 24, 2005

(51) Int. Cl.
*C10G 29/00* (2006.01)

(52) U.S. Cl. ..... 208/289; 208/208; 208/263; 585/860

(58) Field of Classification Search ..... None
See application file for complete search history.

(56) References Cited

U.S. PATENT DOCUMENTS

| | | | |
|---|---|---|---|
| 2,051,873 | A | 8/1936 | Lowry |
| 2,158,050 | A | 5/1939 | Bereslavsky |
| 3,239,320 | A | 3/1966 | Oberdorfer |
| 4,473,378 | A | 9/1984 | Hanlon et al. |
| 4,541,838 | A | 9/1985 | Zaweski et al. |
| 5,411,711 | A | 5/1995 | Swars |
| 5,752,989 | A | 5/1998 | Henly et al. |
| 5,976,201 | A | 11/1999 | Barry et al. |

FOREIGN PATENT DOCUMENTS

| | | | |
|---|---|---|---|
| EP | 0 428 393 | B1 | 5/1991 |
| EP | 0457589 | A * | 11/1991 |
| EP | 1 191 090 | A2 | 3/1992 |
| EP | 0 541 585 | B1 | 5/1993 |
| EP | 1 233 051 | A1 | 8/2002 |
| EP | 1 321 504 | A2 | 6/2003 |
| GB | 2 158 091 | A | 11/1985 |
| RU | 2182163 | | 10/2002 |
| RU | 2208039 | | 10/2003 |

OTHER PUBLICATIONS

Owen et al. "Automotive Fuels Reference Book," 2nd edition. Society of Automotive Engineers, pp. 520-523 (1995).

(Continued)

*Primary Examiner*—Tam M. Nguyen
(74) *Attorney, Agent, or Firm*—John H. Thomas, P.C.

(57) ABSTRACT

A reduction in the formation and presence of peroxides in low sulfur diesel fuels is obtained through the combination of those fuels with an organic nitrate combustion improver. The reduction in the amount of peroxides means that the fuel system elastomers will be more durable, as they are not being corroded by as much peroxide formed in the fuel, fuel color durability is improved, fuel stability is enhanced, and fuel sediments are reduced.

8 Claims, 2 Drawing Sheets

OTHER PUBLICATIONS

Vardi et al., "Peroxide Formation in Low Sulfur Automotive Diesel Fuels," SAE Paper 920826, Feb. 1, 1992.
Bacha et al., "Diesel Fuel Thermal Stability at 300 F," 6th International Conference on Stability and Handling of Liquid Fuels, Vancouver, Canada; Oct. 13-17, 1997.
Fodor et al., "Peroxide Formation in Jet Fuels," Energy and Fuels, 1988 pp. 729-734.
Turkish Search Report; Application No. 2004/02226; mailed Nov. 14, 2006; 2 pages.
Protest of Canadian Patent Application CA 2.477 671; 11 pages.

* cited by examiner

Figure 1

ULSD Test Fuels
Selected Properties

| Property | ASTM Method | Fuel ID | |
|---|---|---|---|
| | | A | B |
| Cetane number | D 613 | 42.3 | 59.2 |
| Aromatics, vol% | D 1319 | 24.8 | 21.7 |
| Saturates, vol% | D 1319 | 73.6 | 76.3 |
| Olefins, vol% | D 1319 | 1.6 | 2.0 |
| Sulfur, ppm (wt.) | D 5453 | 1 | 17 |
| Specific Gravity | D 4052 | .831 | .836 |
| 10% B.P., °C | D 86 | 213 | 257 |
| 50% B.P., °C | D 86 | 262 | 296 |
| 90% B.P., °C | D 86 | 322 | 338 |
| Kinematic visc., 40°C, cSt | D 445 | 2.48 | 4.02 |

METHOD OF REDUCING AMOUNT OF PEROXIDES, REDUCING FUEL SEDIMENTS AND ENHANCING FUEL SYSTEM ELASTOMER DURABILITY, FUEL STABILITY AND FUEL COLOR DURABILITY

This present invention relates to a method including the addition of an organic nitrate combustion improver to a middle distillate fuel to reduce formation or presence in the fuel of peroxides. Especially in low or ultra-low sulfur fuels, the addition of an organic nitrate combustion improver, for instance 2-ethylhexyl nitrate, retards the formation and/or reduces the presence of peroxides, and prolongs the life of gaskets, hoses, seals and other elastomeric parts exposed to the peroxides. Other benefits include a reduction in fuel sediments, and enhanced fuel stability and color durability.

BACKGROUND

There is a current trend towards the use of ultra low sulfur diesel fuels, commonly referred to as fuels having 50 ppm sulfur or less ("ULSD fuels"). This trend toward the use of ULSD fuels has caused substantial combustion system changes and equally significant changes in fuel specifications. Many industrialized nations are reducing and/or have already reduced their mandatory maximum specifications for sulfur content. As a result, there are new concerns with respect to the performance and handling of the fuels formulated to meet the new specifications.

One concern with ULSD fuels is that the removal of sulfur compounds, some of which are effective peroxide scavengers and/or decomposers, may allow peroxides to build up in these fuels. The potential increase in peroxides is detrimental to fuel systems, because peroxides are know to degrade fuel system elastomers. The increase in peroxides, therefore, could cause the possible failure of seals, gaskets and hoses in a fuel system that uses ULSD fuels. See, for instance, Owen and Coley, *Automotive Fuels Reference Book, Second Edition*, 1995, pp. 520-523. The potential seriousness of this problem is also well documented in the problems with jet fuels in the 1960's and 1970's where high peroxide content in those fuels was associated with a high failure rate for fuel hoses, gaskets and seals in those systems. E.g., Fodor, et al., "Peroxide Formation in Jet Fuels," *Energy and Fuels*, 1988, pp. 729-34.

Other concerns that arise when peroxide levels increase include fuel stability, color durability, and fuel sediments. These concerns are discussed generally in Bacha and Lesnini, "Diesel Fuel Thermal Stability at 300° F.," Sixth International Conference on Stability and Handling of Liquid Fuels, Vancouver, Canada, Oct. 13-17, 1997; Vardi and Kraus, "Peroxide Formation in Low Sulfur Automotive Diesel Fuels," SAE Paper No. 920826.

It is conventional wisdom that combustion improvers like organic nitrate combustion improvers may affect peroxide formation. It has been observed that combustion improvers may in fact promote the formation of peroxides at relatively higher temperatures. This observation is assumed true for all temperatures. Accordingly, there is a possible concern that ULSD fuels, and particularly those containing combustion improvers, may have a propensity to form detrimental levels of peroxides and hydroperoxides during storage.

BRIEF DESCRIPTION OF THE DRAWINGS

FIG. 1 is a chart characterizing the fuels that were tested as described herein.

DETAILED DESCRIPTION

Figure 2:
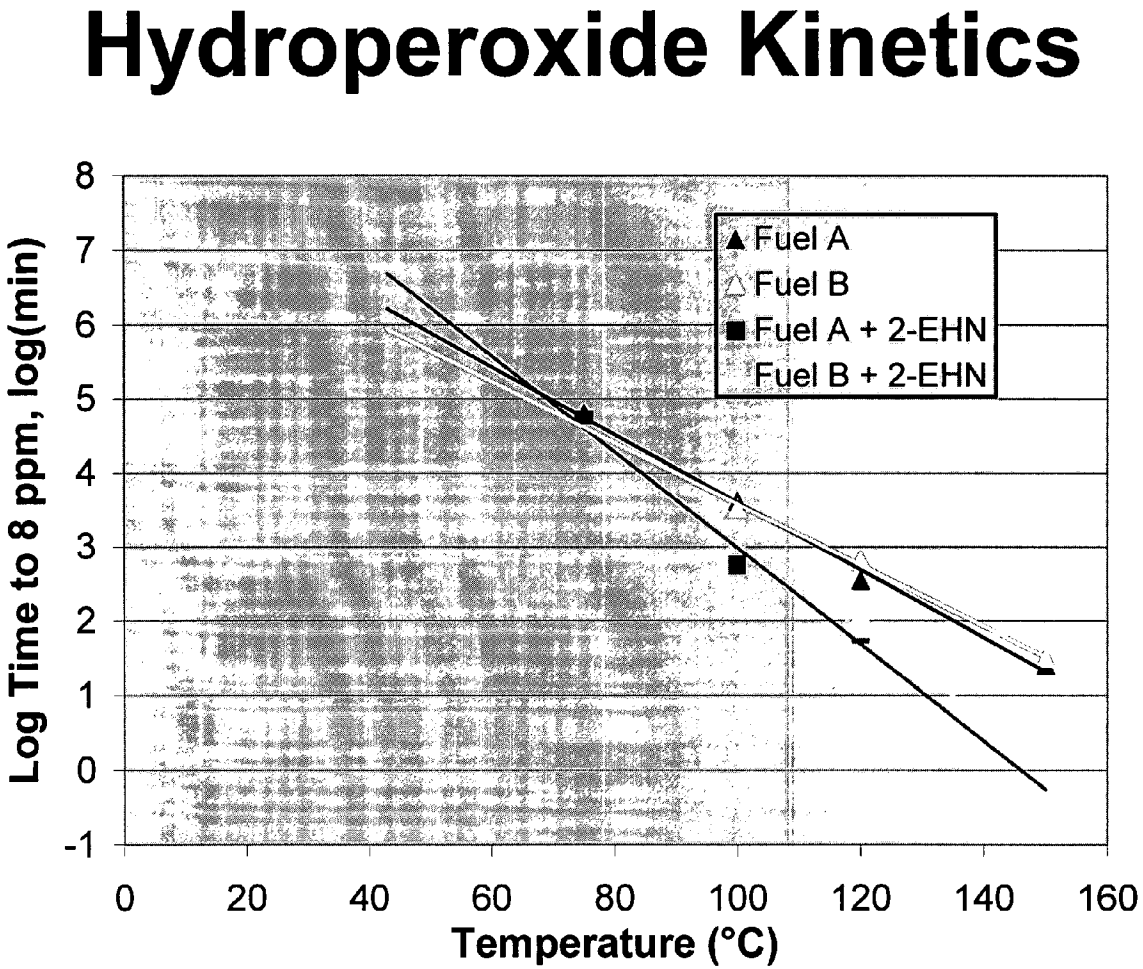
FIG. 2 is a graph demonstrating hydroperoxide kinetics of the fuels tested as described herein.

A reduction in the formation or presence of peroxides and hydroperoxides in ultra low sulfur diesel fuels is obtained through the combination of an organic nitrate combustion improver with the fuel. By reducing the amount and/or formation of peroxides and hydroperoxides, it is possible to enhance the durability of middle distillate fuel system elastomers, enhance fuel stability, enhance color durability and reduce formation of fuel sediments.

It is believed that the interaction between organic nitrate combustion improvers and peroxides/hydroperoxides includes a mechanism that is dependant on temperature. "Peroxides" is meant herein to include peroxides, hydroperoxides, mixtures thereof and precursors thereof. As demonstrated in testing discussed herein, fuels containing organic nitrate combustion improvers actually have increased peroxide levels over time as compared to fuels without any organic nitrate combustion improver, but only at high temperatures (temperatures greater than about 70° C.). This finding generally of a higher amount of peroxides resulting from the use of organic nitrate combustion improvers is consistent with conventional wisdom. However, it has been discovered that at temperatures below about 70° C., there is actually an unexpected reduction in the amount or the formation of peroxides when an organic nitrate combustion improver is combined with an ULSD fuel.

A method of reducing the amount of peroxides in low sulfur, middle distillate fuels comprises the steps of: providing a middle distillate fuel having a sulfur content of about 50 ppm or less; combining the fuel with an organic nitrate combustion improver; wherein the amount of organic nitrate combustion improver combined with the fuel reduces the amount of peroxides in the fuel as compared with a middle distillate fuel without the organic nitrate combustion improver.

Fuels are rarely stored at temperatures of about 70° C. or higher. If a fuel ever reaches that temperature in the operation of a combustion system, then the fuel would only remain at that temperature for a very short time before combustion. As a result, a relatively insignificant increase in peroxide presence and/or formation would result, if at all, from the use of an organic nitrate combustion improver. More importantly, middle distillate fuel may often be stored for days/weeks/months before use. Typical storage temperatures would be well below 70° C. Realistically, therefore, it is significant that an organic nitrate combustion improver is discovered to retard the formation of or reduce the amount of peroxides in ULSD fuels.

A presentation entitled "Hydroperoxide Formation in Ultra-Low Sulfur Diesel Fuels" by Joshua J. Bennett and Scott D. Schwab was prepared for the International Conference on Stability and Handling of Liquid Fuels, Steamboat Springs, Colo. on Sep. 19, 2003. That presentation and the materials presented are incorporated herein by reference as if set forth in their entirety.

The hydrocarbonaceous fuels utilized herein are comprised in general of mixtures of hydrocarbons which fall within the distillation range of about 160 to about 370<C. Such fuels are frequently referred to as "middle distillate fuels" since they comprise the fractions which distill after gasoline. Such fuels include diesel fuels, biodiesel and biodiesel-derived fuels, burner fuel, kerosenes, gas oils, jet fuels, and gas turbine engine fuels.

In an embodiment, applicable middle distillate fuels are those characterized by having the following distillation profile:

| | ° F. | ° C. |
|---|---|---|
| IBP | 250-500 | 121-260 |
| 10% | 310-550 | 154-288 |
| 50% | 350-600 | 177-316 |
| 90% | 400-700 | 204-371 |
| EP | 450-750 | 232-399 |

Diesel fuels having a clear cetane number (i.e., a cetane number when devoid of any cetane improver such as an organic nitrate) in the range of 30 to 60 may also be used. In another example are those in which the clear cetane number is in the range of 40 to 50.

The organic nitrate combustion improvers (also frequently known as ignition improvers) comprise nitrate esters of substituted or unsubstituted aliphatic or cycloaliphatic alcohols which may be monohydric or polyhydric. The organic nitrates may be substituted or unsubstituted alkyl or cycloalkyl nitrates having up to about 10 carbon atoms, for example from 2 to 10 carbon atoms. The alkyl group may be either linear or branched (or a mixture of linear and branched alkyl groups). Specific examples of nitrate compounds suitable for use as nitrate combustion improvers include, but are not limited to the following: methyl nitrate, ethyl nitrate, n-propyl nitrate, isopropyl nitrate, allyl nitrate, n-butyl nitrate, isobutyl nitrate, sec-butyl nitrate, tert-butyl nitrate, n-amyl nitrate, isoamyl nitrate, 2-amyl nitrate, 3-amyl nitrate, tert-amyl nitrate, n-hexyl nitrate, n-heptyl nitrate, sec-heptyl nitrate, n-octyl nitrate, 2-ethylhexyl nitrate, sec-octyl nitrate, n-nonyl nitrate, n-decyl nitrate, cyclopentylnitrate, cyclohexyl nitrate, methylcyclohexyl nitrate, isopropylcyclohexyl nitrate, and the like. Also suitable are the nitrate esters of alkoxy substituted aliphatic alcohols such as 2-ethoxyethyl nitrate, 2-(2-ethoxyethoxy)ethyl nitrate, 1-methoxypropyl-2-nitrate, and 4-ethoxybutyl nitrate, as well as diol nitrates such as 1,6-hexamethylene dinitrate and the like. For example the alkyl nitrates and dinitrates having from 5 to 10 carbon atoms, and most especially mixtures of primary amyl nitrates, mixtures of primary hexyl nitrates, and octyl nitrates such as 2-ethylhexyl nitrate are also included.

As is well known, nitrate esters are usually prepared by the mixed acid nitration of the appropriate alcohol or diol. Mixtures of nitric and sulfuric acids are generally used for this purpose. Another way to making nitrate esters involves reacting an alkyl or cycloalkyl halide with silver nitrate.

The concentration of nitrate ester or other organic nitrate combustion improver in the middle distillate fuel can be varied within relatively wide limits such that the amount employed is at least sufficient to cause a reduction in the presence and/or formation of peroxides. This amount may fall within the range of 100 to 5,000 parts by weight per million parts of fuel.

Other additives may be included within the fuel compositions described herein provided they do not adversely affect the amount or formation of peroxides otherwise obtained herein. Thus, use may be made of one or more of such components as corrosion inhibitors, antioxidants, anti-rust agents, detergents and dispersants, fuel lubricity additives, demulsifiers, dyes, inert diluents, cold flow improvers, conductivity agents, metal deactivators, stabilizers, antifoam additives, deicers, biocides, odorants, drag reducers, combustion improvers, e.g., including MMT, oxygenates and like materials. These additives may also be used in combinations as additive packages.

Sulfur compounds themselves may reduce the amount of peroxide in a fuel, so the present analysis is directed to low sulfur fuels. For example, ultra-low sulfur fuels containing the organic nitrate combustion improver may have less than about 100 ppm sulfur, or alternatively, less than about 50 ppm sulfur. Still further alternatives include fuels having less than about 20 ppm or less than about 10 ppm of sulfur.

The advantages achievable from the addition of an organic nitrate combustion improver to a low sulfur fuel are demonstrated in the following tests. For purposes of these tests, it is deemed detrimental to have a concentration of peroxides greater than about 8 ppm. Accordingly, measurements made herein were with respect to time/temperature conditions of specific fuels which result in a concentration of a peroxide greater than about 8 ppm. First, two different fuels were tested. These fuels were identified as Fuel A and Fuel B. Fuels having significantly different properties were identified in order to best evaluate how different fuels may have different results. FIG. 1 defines the two Fuels A and B that were used in the testing.

Fuels A and B were each tested with and without the addition of 2500 ppm 2-ethylhexyl nitrate combustion improver. As a result of engine testing, it was determined the precise fuel conditions (temperature and residence time) which generate detrimental concentrations (greater than 8 ppm) of peroxides. Given the known points on the graph, lines were calculated to represent the peroxide formation kinetics. The specific peroxide kinetics that were indicated are shown in FIG. 2.

As is evident from the kinetics demonstrated in FIG. 2, the fuels containing the organic nitrate combustion improver (e.g., 2-EHN) each demonstrate a longer time to reach a detrimental level of peroxides when fuel temperatures are below approximately 70° C. The specific temperature at which such detrimental levels of peroxides would arise would be the intersection of the demonstrated linear kinetics for the fuels with and without the organic nitrate combustion improver.

The organic nitrate combustion improver with a middle distillate fuel enables each of the (1) elastomer durability benefit, (2) enhanced fuel stability, (3) fuel sediment reduction, and (4) enhanced color durability obtained by keeping the amount of peroxides in ULSD fuels less than about 8 ppm.

Based on the foregoing tests and calculation, it is seen that peroxide formation and/or presence (i.e., the amount of peroxide) is reduced in middle distillate fuels containing an organic nitrate combustion improver. This may be a significant benefit in prolonging the life of elastomeric materials contacting the fuels when the fuels are stored for long periods of time. Other benefits include enhanced fuel stability, color durability, and a reduction in fuel sediments.

It is expected that the durability of elastomers susceptible to degradation by exposure to peroxides in a fuel system might thus be extended or enhanced by at least 25% in terms of miles driven, gallons of fuel combusted or days/years of service as compared to the durability of elastomers in a fuel system not containing an organic nitrate combustion improver. In another embodiment, the elastomer durability is extended or enhanced by at least 10% as compared to the durability of elastomers exposed to fuels not containing an organic nitrate combustion improver.

It is expected that the fuel stability of a middle distillate fuel might thus be extended or enhanced by at least 25% in terms of miles driven, gallons of fuel combusted or days/years of service as compared to the fuel stability of a fuel not containing an organic nitrate combustion improver. In another embodiment, the fuel stability is extended or enhanced by at least 10% as compared to the stability of fuels not containing an organic nitrate combustion improver.

It is expected that the durability of fuel color might thus be extended or enhanced by at least 25% in terms of miles driven, gallons of fuel combusted or days/years of service as compared to the durability of fuel color in a fuel not containing an organic nitrate combustion improver. In another embodiment, the fuel color durability is expected to be extended or enhanced by at least 10% as compared to the durability of fuels not containing an organic nitrate combustion improver.

It is expected that the formation or presence of fuel sediments is reduced by at least 25% in terms of miles driven, gallons of fuel combusted or days/years of service as compared to the amount of fuel sediments in a fuel not containing an organic nitrate combustion improver. In another embodiment, the amount of fuel sediments is reduced or enhanced by 10% as compared to the amount of fuel sediments in fuels not containing an organic nitrate combustion improver.

It is to be understood that the reactants and components referred to by chemical name anywhere in the specification or claims hereof, whether referred to in the singular or plural, are identified as they exist prior to coming into contact with another substance referred to by chemical name or chemical type (e.g., base fuel, solvent, etc.). It matters not what chemical changes, transformations and/or reactions, if any, take place in the resulting mixture or solution or reaction medium as such changes, transformations and/or reactions are the natural result of bringing the specified reactants and/or components together under the conditions called for pursuant to this disclosure. Thus the reactants and components are identified as ingredients to be brought together either in performing a desired chemical reaction or in forming a desired composition (such as an additive concentrate or additized fuel blend). It will also be recognized that the additive components can be added or blended into or with the base fuels individually per se and/or as components used in forming preformed additive combinations and/or sub-combinations. Accordingly, even though the claims hereinafter may refer to substances, components and/or ingredients in the present tense ("comprises", "is", etc.), the reference is to the substance, components or ingredient as it existed at the time just before it was first blended or mixed with one or more other substances, components and/or ingredients in accordance with the present disclosure. The fact that the substance, components or ingredient may have lost its original identity through a chemical reaction or transformation during the course of such blending or mixing operations or immediately thereafter is thus wholly immaterial for an accurate understanding and appreciation of this disclosure and the claims thereof.

At numerous places throughout this specification, reference has been made to a number of technical papers. All such cited documents are expressly incorporated in full into this disclosure as if fully set forth herein.

This invention is susceptible to considerable variation in its practice. Therefore the foregoing description is not intended to limit, and should not be construed as limiting, the invention to the particular exemplifications presented hereinabove. Rather, what is intended to be covered is as set forth in the ensuing claims and the equivalents thereof permitted as a matter of law.

Patentee does not intend to dedicate any disclosed embodiments to the public, and to the extent any disclosed modifications or alterations may not literally fall within the scope of the claims, they are considered to be part of the invention under the doctrine of equivalents.

What is claimed is:

1. A method of reducing the amount of peroxides in low sulfur, middle distillate fuels comprising the steps of:

providing a middle distillate fuel having a sulfur content of about 50 ppm or less;

combining the fuel with an organic nitrate combustion improver;

maintaining the combined fuel and organic nitrate combustion improver at a temperature below 70 degrees Celsius;

wherein the amount of organic nitrate combustion improver combined with the fuel reduces the amount of peroxides in the fuel as compared with a middle distillate fuel without the organic nitrate combustion improver.

2. A method as described in claim 1, wherein the organic nitrate combustion improver comprises 2-ethylhexyl nitrate.

3. A method as described in claim 2, wherein the 2-ethylhexyl nitrate is combined in an amount of from about 100 to 5000 ppm wt. of the fuel.

4. A method as described in claim 3, wherein the 2-ethylhexyl nitrate is combined in an amount of about 2500 ppm wt. of the fuel.

5. A method as described in claim 1, wherein the middle distillate fuel is selected from the group consisting of diesel fuel, biodiesel fuel, burner fuel, kerosene, gas oil, jet fuel, and gas turbine engine fuel.

6. A method as described in claim 1, wherein the fuel has a sulfur content of about 20 ppm or less.

7. A method as described in claim 1, wherein the fuel has a sulfur content of about 10 ppm or less.

8. A method as described in claim 1, wherein the fuel further comprises one or more components selected from the group consisting of: corrosion inhibitors, antioxidants, antirust agents, detergents and dispersants, fuel lubricity additives, demulsifiers, dyes, inert diluents, cold flow improvers, conductivity agents, metal deactivators, stabilizers, antifoam additives, de-icers, biocides, odorants, drag reducers, combustion improvers, e.g., including MMT, oxygenates and like materials.

* * * * *